US006838998B1

(12) United States Patent
Brown et al.

(10) Patent No.: US 6,838,998 B1
(45) **Date of Patent: *Jan. 4, 2005**

(54) MULTI-USER GLOBAL POSITION TRACKING SYSTEM AND METHOD

(75) Inventors: William W. Brown, Anderson, SC (US); David G. Smith, Anderson, SC (US)

(73) Assignee: Eworldtrack, Inc., Anderson, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/497,733

(22) Filed: Feb. 4, 2000

Related U.S. Application Data

(60) Provisional application No. 60/118,913, filed on Feb. 5, 1999, and provisional application No. 60/153,350, filed on Sep. 10, 1999.

(51) Int. Cl.[7] ..... G08B 5/22

(52) U.S. Cl. ..... 340/825.49; 340/825.36; 340/5.61; 340/539.1; 340/539.13; 340/573.1; 340/988; 340/989; 701/213; 342/357.07; 342/357.09

(58) Field of Search ..... 340/825.49, 825.36, 340/5.61, 539, 573.1, 539.1, 539.13, 988, 989; 701/213; 342/357.07, 357.09; 379/38

(56) References Cited

U.S. PATENT DOCUMENTS

| | | | | |
|---|---|---|---|---|
| 4,750,197 A | | 6/1988 | Denekamp et al. | |
| 5,043,736 A | | 8/1991 | Darnell et al. | 342/357.1 |
| 5,122,959 A | | 6/1992 | Nathanson et al. | 701/117 |
| 5,317,323 A | | 5/1994 | Kennedy et al. | 342/457 |
| 5,388,147 A | | 2/1995 | Grimes | 455/404 |
| 5,576,716 A | | 11/1996 | Sadler | 342/357.07 |
| 5,594,425 A | | 1/1997 | Ladner et al. | |
| 5,629,678 A | | 5/1997 | Gargano et al. | 340/573.4 |
| 5,712,619 A | | 1/1998 | Simkin | 340/539 |
| 5,731,757 A | | 3/1998 | Layson, Jr. | 340/573.1 |
| 5,742,233 A | | 4/1998 | Hoffman et al. | 340/573.1 |
| 5,812,087 A | | 9/1998 | Krasner | 342/357 |
| 5,835,377 A | | 11/1998 | Bush | |
| 5,835,907 A | | 11/1998 | Newman | 707/10 |
| 5,838,237 A | | 11/1998 | Revell et al. | 340/573.1 |
| 5,892,454 A | | 4/1999 | Schipper et al. | 340/825.37 |
| 5,905,461 A | | 5/1999 | Neher | 342/357 |
| 5,914,675 A | | 6/1999 | Tognazzini | 340/989 |
| 5,929,806 A | | 7/1999 | Birchler et al. | 342/357 |
| 6,014,080 A | | 1/2000 | Layson, Jr. | 340/573.1 |
| 6,131,067 A | * | 10/2000 | Girerd et al. | 701/213 |
| 6,263,280 B1 | * | 7/2001 | Stingone, Jr. | 701/213 |
| 6,392,565 B1 | * | 5/2002 | Brown | 340/988 |

FOREIGN PATENT DOCUMENTS

EP 0 528 090 A1 2/1993

* cited by examiner

*Primary Examiner*—Michael Horabik
*Assistant Examiner*—Yves Dalencourt
(74) *Attorney, Agent, or Firm*—McNair Law Firm, PA; Cort Flint

(57) ABSTRACT

An Internet based personal tracking system for tracking the position of a portable location unit by a remote user comprising a web host connected to the Internet having a computer storage medium, a portable location unit having a processor for receiving geo-position information, and generating geo-position data representing the position of said location unit, a transceiver included in said location unit for transmitting said position signal to said web host in response to a call signal being received from said web host, a power supply for supplying power to said processor and said transceiver; and a computer program residing on said web host having an input module for receiving a tracking request signal from the remote user via the Internet, a processing module for processing said tracking request signal, and a communication module for initializing communication with said location unit in response to tracking said request signal, and a location module for outputting said call signal to said location unit and for receiving said geo-position data from said location unit; and a display module for outputting said position dataset to the remote user via the Internet for display of the location unit's position at the remote user's site.

19 Claims, 5 Drawing Sheets

A

MULTI-USER GLOBAL POSITION TRACKING SYSTEM AND METHOD

This application claims the benefit of Provisional Application Ser. No. 60/118,913, filed Feb. 5, 1999, and 60/153,350, filed Sep. 10, 1999.

FIELD OF THE INVENTION

The present invention relates to a system and method for tracking multiple individuals from multiple remote locations on a concurrent basis, specifically receiving and displaying at a remote location the geo-position of an individual received through a communications network, and a personal location unit which can be carried by an individual or object to be tracked.

BACKGROUND OF THE INVENTION

Personal safety has become of utmost is the upmost concern in today's society. Unfortunately, there is an ever growing risk of abductions and kidnaping. The location of lost and missing persons, elderly individuals, persons with decreased memory capacity such as Alzheimers patients, or persons in danger or in emergency situations has become a major national problem. The advent of wireless devices for personal communication, such as cellular telephones, has helped lessen this problem. However, communication with these devices can typically only be initiated by the individual carrying the device. It is often desirable for concerned persons to be able to find the location of another person who may not be carrying a cellular phone. For example, a concerned parent may wish to know the location of a lost child or perhaps a lost family member with a medical condition such as Alzheimer's disease. Children subject to custody battles are often abducted and need to be located. Alzheimer's patients who wander away from locations without the ability to find their way home need to be located.

GPS tracking systems have become increasingly popular for navigation of airplanes, ships, boats, automobiles, and other objects. The GPS tracking systems, which navigate off of fixed satellites, are often used in automatic control systems for controlling the guidance of airplanes, ships, boats, and the like.

Heretofore, various personal alarms have been provided which utilize GPS tracking systems in the event of an assault, medical emergency, or any other intrusive wrongdoing. For example, U.S. Pat. No. 5,712,619 discloses a GPS personal alarm using GPS technology and cellular phone technology to transmit the users longitudinal and latitudinal position to a monitoring station which relays the users position to the proper authorities. The system employs an unique housing structure and plunger extending through the housing structure which triggers the alarm, among other things, to cause a position signal to be emitted.

U.S. Pat. No. 5,742,233 discloses a signaling system which comprises a portable signaling unit, a remote alarm switch device, a central dispatch station, and a wireless communication system such as a cellular telephone, and a GPS tracking system. The remote alarm switch device is provided by a bracelet worn by the person. The signaling unit is also worn by the person. If the bracelet becomes removed from the person, the signaling unit is activated. The system uses a rechargeable lithium battery as a power source.

Various other GPS tracking systems for personal use are noted in the above two patents. However, a problem exists in there prior art devices because of the power required by portable devices. Even in the case of a rechargeable lithium battery, as disclosed in U.S. Pat. No. 5,742,233 above, there is a chance that the power source may be low when an alarm signal is needed from the device. The prior art devices have tended to be relatively complicated and power hungry.

The previous GPS devices have been designed to be initiated by the individual carrying the positioning device and not a remote user requesting the location of the individual. Neither are the systems capable or designed to handle a large number of concurrent tracking requests as they are primarily designed to notify emergency authorities such as police or 911 operators.

For example, U.S. Pat. No. 5,712,619 provides for a personal alarm system in the event of an emergency where the wearer initiates an emergency signal. In the event of an emergency the wearer pulls a pin and the unit makes a cellular call to a monitoring station and transmits the position of the unit. The monitoring station sends the information to the proper authorities such as emergency personnel.

The devices shown in U.S. Pat. Nos. 5,914,675 and 5,742,233 also can transmit GPS information in response to an emergency trigger initiated by the wearer. Once initiated, the device transmits a distress signal for detection by rescue teams.

The device of U.S. Pat. No. 5,835,907, again, will collect and transmit the global position of an individual to emergency services or another location once an emergency button has been activated in the device. This device will also periodically transmit GPS information to a database for later retrieval. Again, the tracking process is initiated by the unit.

The cellular switching system of U.S. Pat. No. 5,388,147 is a telephone switching system which is responsive to an emergency call from a cellular phone user. The particular cellular phone has the capability to transmit geo-position information to the switching system which can be forwarded to emergency authorities.

Thus, while the prior art has provided devices to allow one to determine their present geographical location, and has provided personal devices which may be triggered by a person to send a signal containing his location to a public service entity, the prior art has not provided a tracking system which allows initiating and determining a person's position by a concerned person from a remote location. In particular, a system which does not rely upon an individual to initiate a distress signal.

Moreover, the prior art has not provided a satisfactory personal tracking system which allows for the concurrent use by a large number of remote concerned persons to track a large number of individuals. Such a need exists to allow remote lay personnel such as parents, relatives, or other concerned parties to determine the position of children, the elderly, and Alzheimer's patients, etc., without relying upon official authorities.

Accordingly, it is an object of this invention to provide a tracking system initiated by a concerned user to determine the geographic position of an individual.

Another object of this invention is to track an individual from a remote location without alerting the individual, or others who may be holding the person captive.

Yet another object of this invention is to provide a tracking system allowing a multitude of remote users to concurrently track a multitude of individuals.

Yet another object of this invention is to provide a personal tracking system using a web host connected to the Internet to allow a vast multitude of concerned users to track individuals concurrently.

Accordingly, an object of the present invention is to provide a personal location unit employing a wireless communication and GPS system which is simplified and reliable for use in a remotely activated tracking system.

Another object of the invention is to provide a simple and reliable location unit which automatically answers an inquiry and transmits a position signal without an audio component thus requiring low power.

Another object of the present invention is to provide a simplified and reliable personal emergency location unit employing wireless and GPS technology wherein a back-up battery source is provided having a shelf life which is sufficient to power the device for a single emergency signal in the case of an emergency.

SUMMARY OF THE INVENTION

The above objectives are accomplished according to the present invention by providing a web host connected to the Internet wherein the web host has a position receiving module for receiving the global position of a personal location unit carried by an individual having a unique unit code and system access number. The web host includes an interface module allowing remote users access to the web host through the Internet and retrieve the geo-position of a tracked individual. By using the Internet, the web host is made available to literally millions of individuals allowing a multitude of concerned users to track individuals concurrently.

The personal location unit receives global position information from the GPS system and transmits this information to the web host upon request. Requests to and from the personal location unit are made possible through a wireless communications network. The personal location unit contains a wireless transceiver for accomplishing communication. The personal location unit also includes a position receiver for receiving position data and a processor for calculating the present global position.

Advantageously, the location unit may include a GPS chip carried within an enclosure for reading information from a global positioning satellite system and generating tracking information signals. A processor/modem chip included in the unit receives the tracking signals and generates personal position signals representing the latitude and longitude, or other coordinates, of the person. A transceiver included in the unit receives the position signals and transmits the position signals to a remote station automatically in response to a call being received from the remote station. The processor/modem chip automatically controls the transceiver to transmit the position signal in response to answering the call from the remote station or user, and then hang up. Quite advantageously, the position signal includes a digital signal containing digital data only, and no audio or sound signal. The digital position signal includes a small digital record which includes personal code data identifying a person to which the device is assigned, latitude data, and longitude data. The digital record may also include any necessary protocol data. The small digital record of the position signal requires only a very low power for generation and transmission. In particular, this allows for operation using a miniature auxiliary power source as a back-up power source.

Preferably, a main power supply supplies power to the GPS chip, the processor/modem chip, and the transceiver during normal operation. However, an auxiliary power supply may be provided for supplying power to the processor/chip and transceiver to transmit the position signal when the main power supply is insufficient to transmit the signal.

The above objectives are further achieved, quite advantageously, by utilizing web host computer program embodied in a computer readable medium running on a web host. The program provides instructions for the receiving of a concerned user's request, validating the input, requesting the location from a personal location unit, receiving the location or position data, and supplying a user readable format such as a map or street address to the remote user. The web host is able to provide this function to a multitude of users since each concerned user has a unique access code which is associated with a unique personal location unit number. Thus, a large number of concerned user's requests can be processed concurrently.

To track an individual, the concerned user accesses the web host through the Internet or other multi-user network through the user's terminal. The concerned user requests the web page of the tracking system by accessing a domain name such as www.satcel.com. An initial or home page is displayed at the user's terminal, and the user is asked to enter an access number and personal unit code. This input is received by the web host program and validated. Once validated, the web host program sends a location request to a location module embodied in the web host program to determine the global position of a personal location unit. The location module initiates a cellular phone call to begin wireless communication with the personal location unit through a wireless communication module embodied in the program, and requests the global position from the personal location unit. The location unit automatically answers the call receives global position information from GPS satellites, transmits the position information back to the wireless communication module ,then hangs up. The communication module passes the information to either the location module or a format module. If the location module receives the global coordinates the information is passed to the format module embodied in the web host program. The format module formats the global coordinates in a user readable format such as a graphical map, street address, or position coordinates. The format module is capable of formatting both raw satellite data as well as longitude, latitude, and altitude position coordinates passed by the personal location unit and thereby not requiring a specific data format from the personal unit. The user readable global position information is then passed to the display module embodied in the web host program so that the concerned user can retrieve the global position information in a format readable at the user's terminal. Therefore, the global position of the individual carrying the personal location unit is available for display on the concerned user's terminal allowing the user to know the global position of the individual in real-time.

To perform the tracking function of the present invention for millions of users, the web host program includes a network interface module allowing the web host to form a connection with remote user terminals. In the preferred embodiment, the connection interface provides a connection to either an Internet service provider (ISP) or directly to the Internet backbone. By being connected to the Internet, the web host is accessible to the millions of potential remote users presently connected. Each concerned user can concurrently access the web host, initiate a tracking request, and receive geo-position date of an individual.

The display module included within the web host program also provides any concerned user accessing the web host with a plurality of viewable pages of the web site. For example, when the concerned user first accesses the web host, the home page is displayed on the user's screen.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWINGS

Reference is made to the attached drawings, wherein elements having the same reference numeral designations represent like elements throughout and wherein.

DETAILED DESCRIPTION OF THE PREFERRED EMBODIMENT

The detailed description which follows may be presented in terms of program procedures, modules, and objects, executed on a computer or a network of computers which are a set of computer readable instructions. These procedural and modular descriptions and representations are the means used by those skilled in the art to most effectively convey the substance of their work to others skilled in the art. An object or module as herein described is generally a self-consistent sequence of steps leading to desired results. These steps are those requiring physical manipulations of physical quantities. Usually, these quantities take the steps of electrical or magnetic signals capable of being stored, transferred, combined, compared or otherwise manipulated. More specifically, an object or module is a section of computer readable code which is designed to perform a specific task or tasks. Actual computer executable code need not be contained with one file or one storage medium to constitute an object or module. Objects or modules generally receive input and provide output. The objects or module may receive information passed by another calling object or module and may output information to the calling object. A web host is computer hardware capable of creating and processing computer readable instructions and is not limited to a single computer. For example, mass storage, network communications, and main processing could be executed by three physically separate computers and would still constitute a web host. Therefore, the term "web host" is not intended to be limited to a single computer. Packets are electronic messages or information together with an Internet address which are sent as one unit. A datagram is a complete message and can be sent in many or one separate packet. With these terms in mind, the preferred embodiment is described in more detail.

Figure 1:
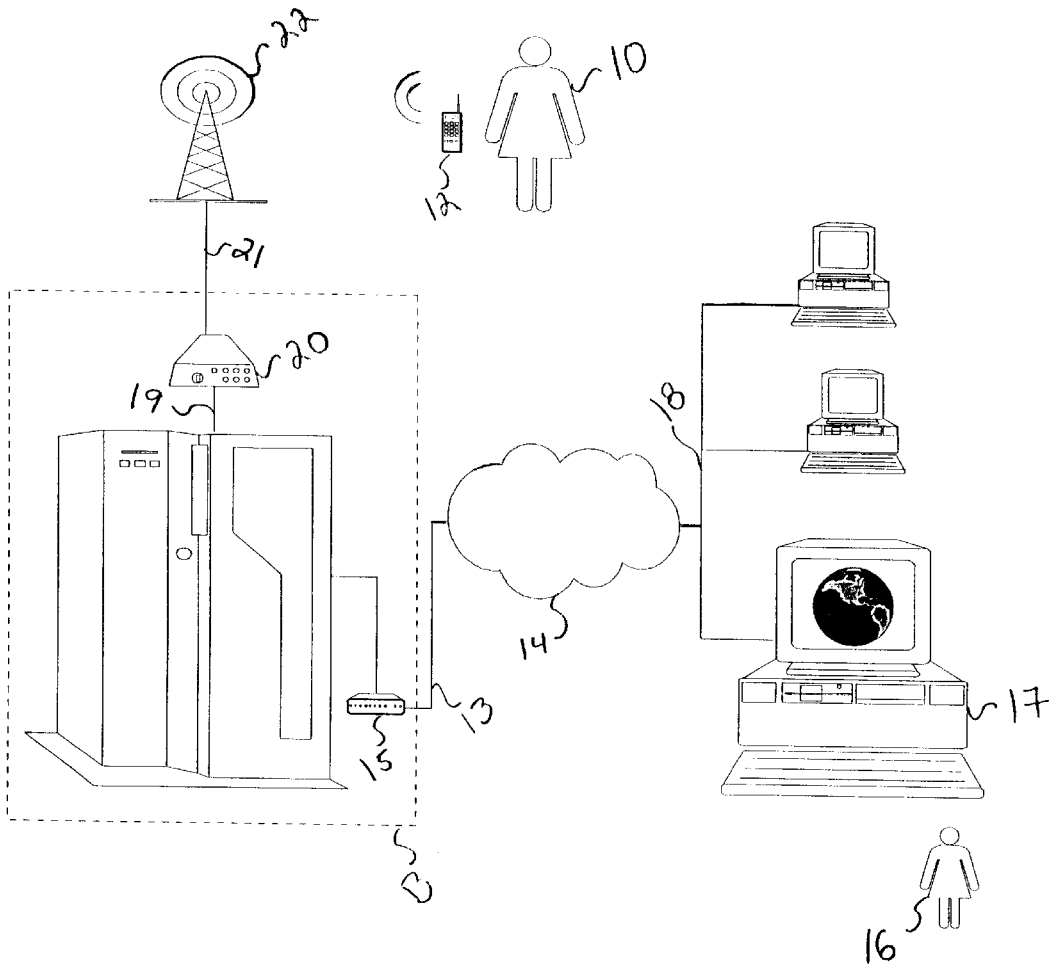
FIG. 1 is a diagram representing the interrelations of the location unit, web host, and remote user terminal.

Referring to the drawings, the invention will now be described in further detail. This invention provides an Internet based personal tracking system, designated generally as A, for tracking a position of an individual 10 in possession of personal location unit 12 of FIG. 1. The tracking system includes a web host B connected to the Internet 14 through network connection device 15. A computer program runs on web host B and receives input from a concerned user 16 through the user terminal 17. Web host B receives input from location unit 12 through cellular network 22 and modem 20 representing the global position data for individual 10; and makes the position data accessible by concerned user 16 through user's terminal 17. Web host B has a connection 13 to the Internet 14 allowing a multitude of concerned users 16 to access web host B. Each concerned user has a connection 18 to the Internet allowing access to the web host. In addition to a connection with the Internet, web host B has a communication connection 19 for connecting the web host to a modem 20. Modem 20 allows web host B to initiate cellular calls to call a personal location unit 12. When dialing cellular numbers, modem 20 connects to a cellular network 22 through a phone line 21. The web host can then transmit and receive data from personal location unit 12 through cellular network 22 allowing for location unit 12 to send its global position data to web host B.

Figure 2:
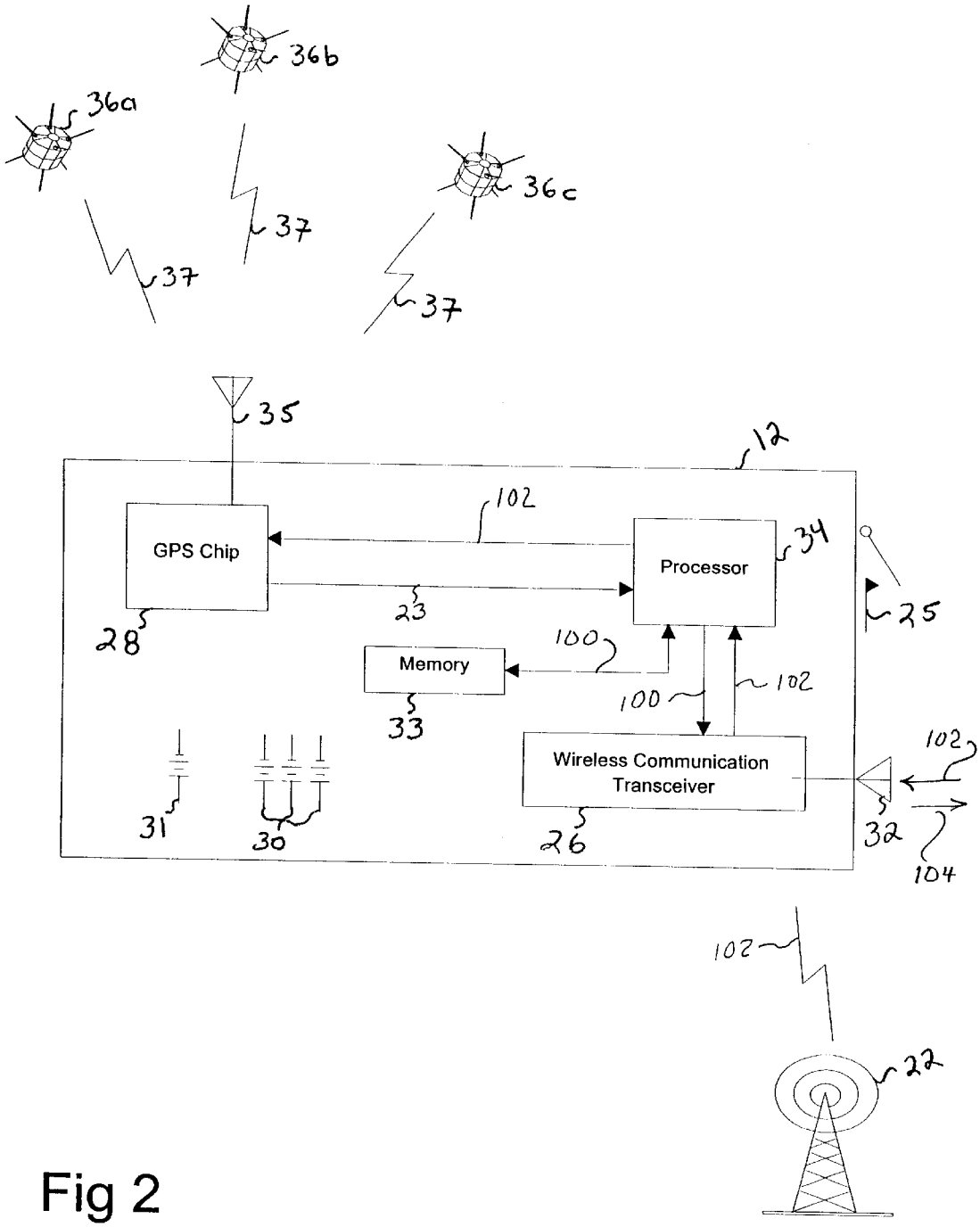
FIG. 2 is a diagram of the components of a location unit.

In order to provide the functionality required for a concerned user to track an individual, location device 12 may be a GPS based device using digital cellular communications. As best can be seen in FIG. 2, location unit 12 may include a GPS chip 28 carried within an enclosure for reading information from a global positioning satellite system. Global position satellites 36*a*–36*c*, generate signals 37 which are received through an antenna 35 of unit 12 and forwarded to GPS chip 28. GPS chip 28 passes the information to a processor 34. Processor 34 then may calculate latitude, longitude, and altitude of the device and, therefore, of the individual. Once calculated the position information is transmitted to a cellular network 22 by a wireless transceiver 26 using a wireless communication antenna 32. Memory 33 may be included within personal unit 12 to hold a number of previous position readings which can be used to show the prior path or track of the location unit and tracked individual, as disclosed in the above application. Processor 34 is programmed to control location unit 12 on stand-by, automatically answer a position inquiry from a concerned user, poll the GPS chip and received GPS position information, transmit the position information to the host, terminate the call, and return to stand-by.

While personal location unit 12 may be powered by a stackable power supply 30, a back-up battery system 31 may also be provided which has an extended shelf-life. Stackable power supply 30 may include stackable thin film batteries as have been recently developed for the cellular market. In the event that the stackable power supply 30 fails, an individual can still activate key 25. Once key 25 is activated, back-up power supply 31 enables location unit 12 to transmit its current GPS location to cellular network 22 even though stackable power supply 30 is fully exhausted. Therefore, the individual can transmit the current location in the event the key is activated.

Since the personal unit 12 only receives location requests and transmits GPS data, the powers required are significantly less than the traditional cellular phone. With this advantage as well as eliminating the need for voice communication, location unit 12 can require less power and be significantly smaller than the traditional cellular phone. However, if an individual does not wish to take advantage of these improvements, any device with wireless communication and global positioning features may be used such as the GPS/Cell-phone Navtalk marked by Garmin.

Figure 4:
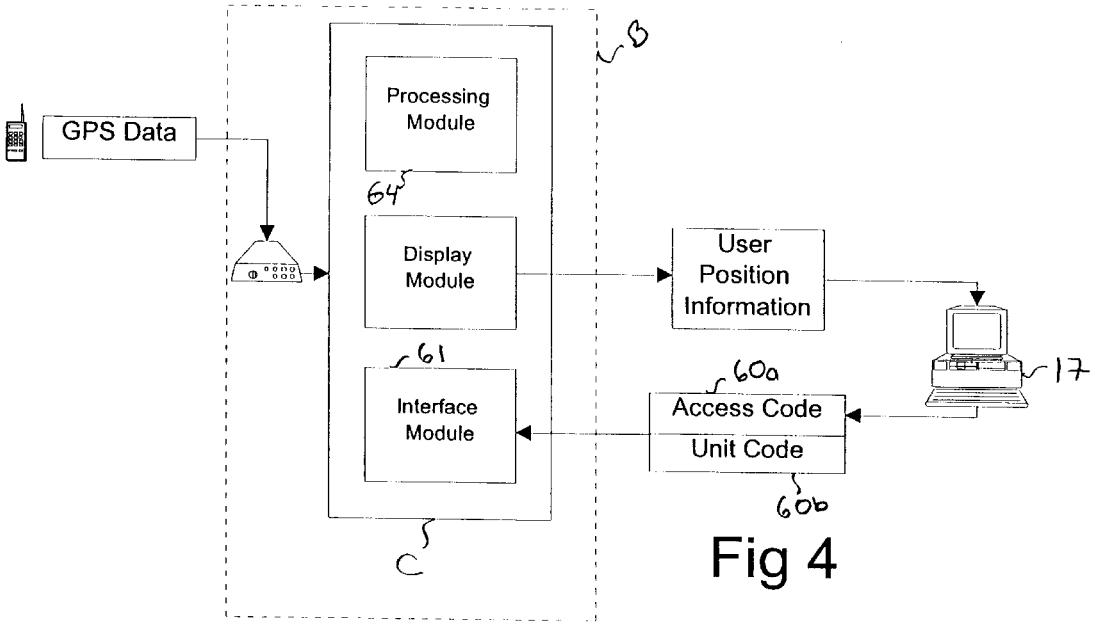
FIG. 4 is a diagram of the general components of computer readable instructions residing on the web host.

FIG. 4 illustrates the basic components of web host program C for providing functionality to this invention. The web host program comprises a set of computer readable instructions embodied in a computer readable medium located on the web host. To initiate a tracking request, the program receives a datagram 60 generated by user terminal 17 sent to web host B. Datagram 60 includes an unique access code 60*a* and an unique unit code 60*b* supplied by the concerned user. The program includes as interface module 61 which includes the instructions necessary for terminal 17 to communicate with web host B. Interface module 61 passes request datagram 60 to a process module 64. Process module 64 includes can include a set of instructions for receiving datagram 60, validating the access and unit codes, and requesting and receiving the position data for making the same available to the concerned user, as more fully described below.

Figure 5:
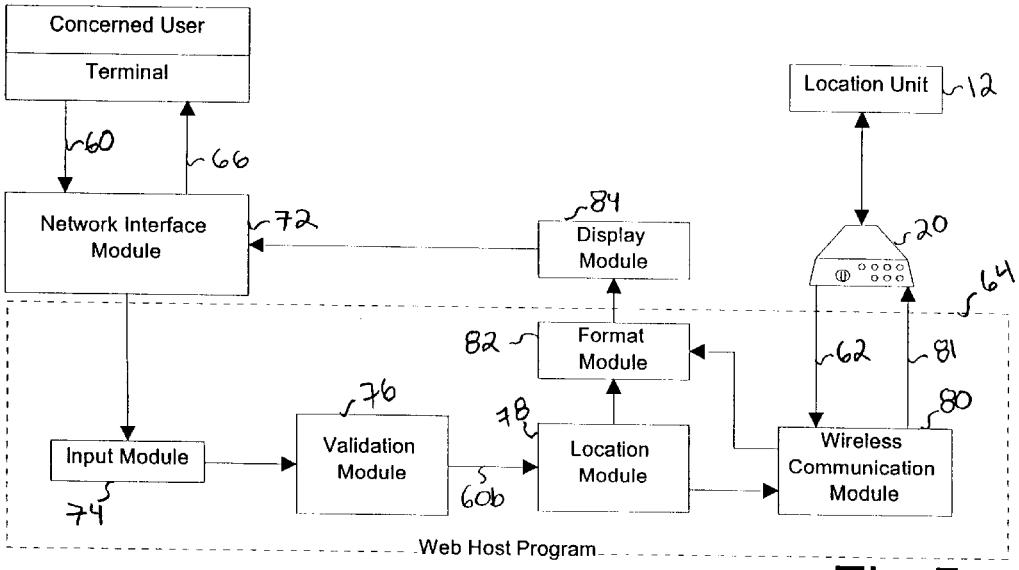
FIG. 5 is a diagram of the modules contained with the computer readable instructions residing on the web host.
Figure 6:
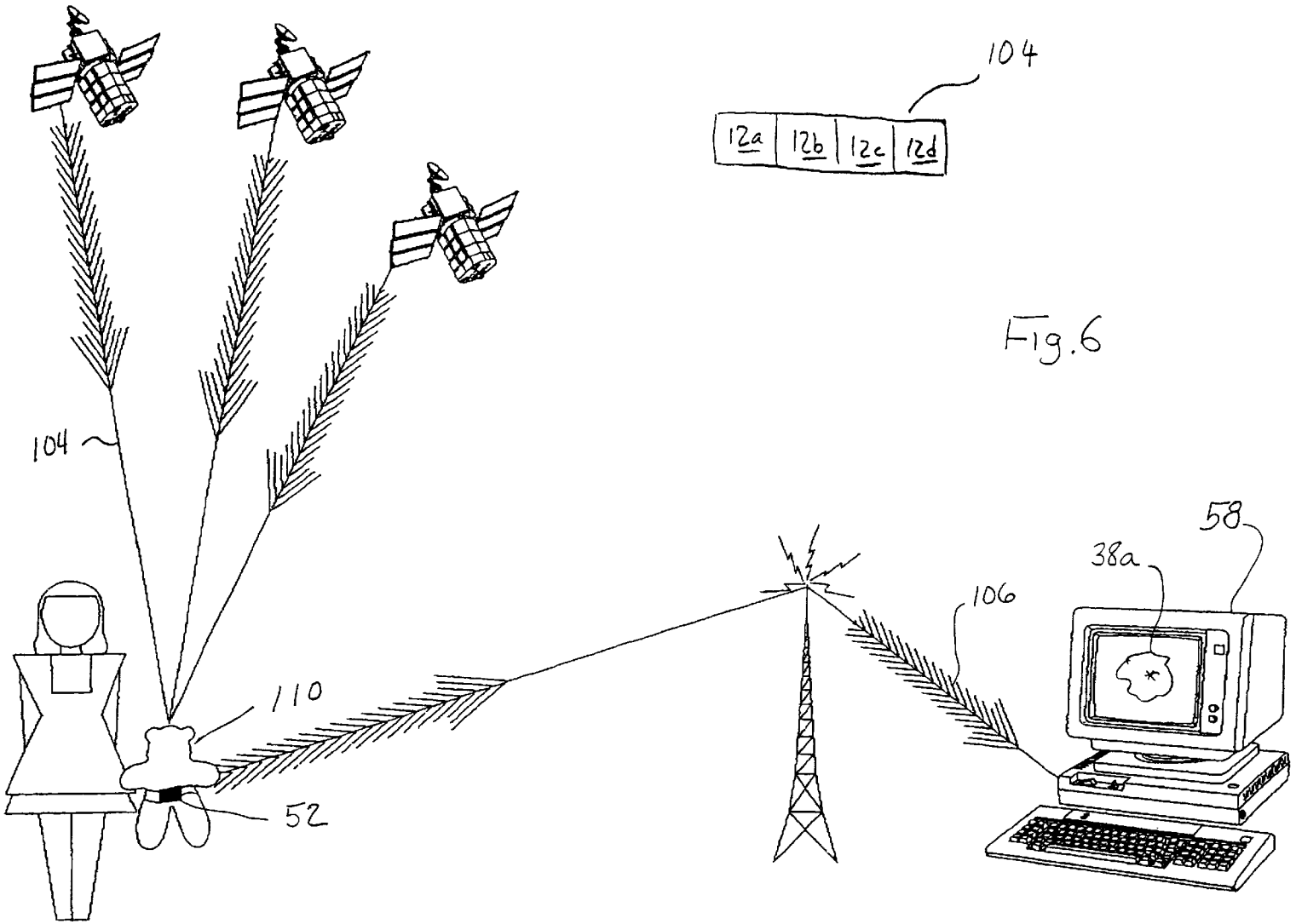
FIG. 6 is a diagram representing the interrelations of the location unit and base station.

As best can be seen in FIG. 5, processing module 64 includes an input module 74 for receiving tracking request datagram 60. There is a validation module 76 having instructions for receiving the access code and determining if the access code is valid and whether processing can continue. There is a location module 78 which receives unit code 60*b* for further processing if the processing continues. Location module 78 includes a set of instructions for initiating wireless communication through a wireless communication module 80. Wireless communication module 80 includes instructions for polling personal location unit 12 by making a cellular phone call through modem 20. Connected wireless communication module 80 sends a position request datagram 81 which received by transceiver 26 of personal unit 12. Wireless communication module 80 also includes the instructions for receiving and processing position data and forwards this data to a format module 82. The format module includes instructions which create position information 66 and provides a user readable representation of the position of individual 10 such as a map display or position coordinates. A display module 84 includes a set of instructions to create a datagram containing user position information 66 to be accessed by the concerned user's terminal 17. Network interface module 72 includes instructions for receiving position information 66 and allowing the concerned user to know and/or display the global position of the individual being tracked. Location unit 12 responds to position request datagram 81 by determining its global position through satellites 36*a*–36*c* (FIG. 2) and temporary stores this global position information. The position data 62 is then transmitted back through modem 20 to wireless communication module 80.

OPERATION

Figure 3:
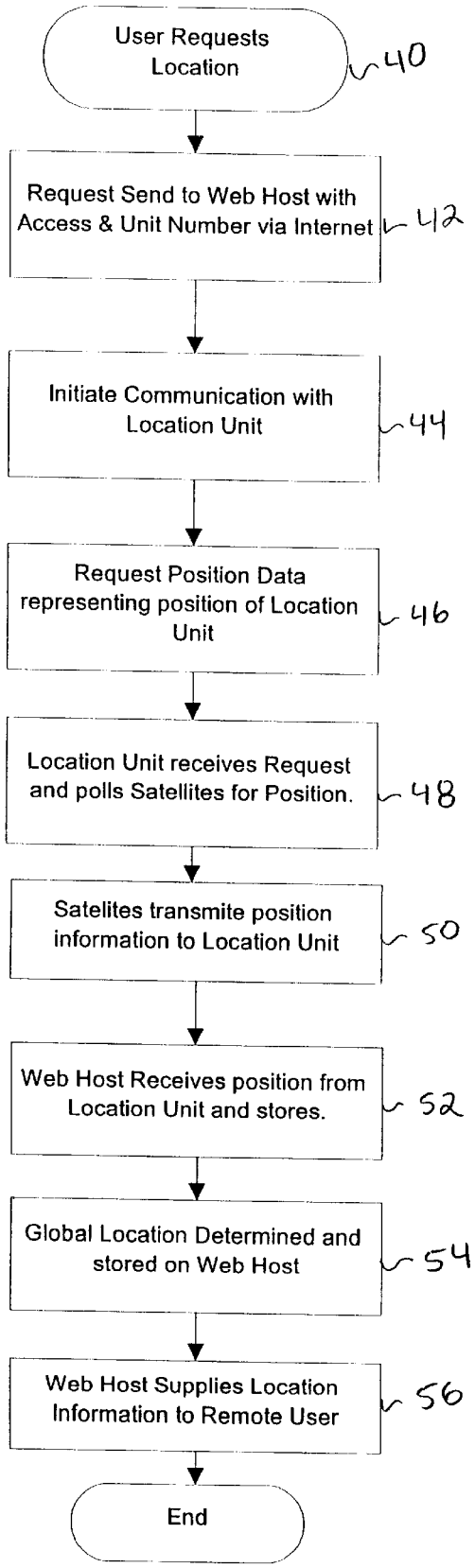
FIG. 3 is a process flow diagram for illustrating the steps of a remote user tracking an individual.

In use, concerned user 16 can discover the global position of individual 10 by accessing web host B through terminal 17 connected to web host B by the Internet. To do this, the concerned user enters a domain name for web host B such as www.satcel.com in step 40 of FIG. 3. When the remote user enters a domain name, a datagram is created at terminal 17 and transmitted across the Internet, from the concerned user to the web host, which contains the Internet addresses of the user. At this point, the concerned user enters a tracking request which includes a system access number 60*a* and a personal unit code 60*b* which is unique to personal unit 12, at step 42. A datagram is created containing the concerned user's input and sent to the web host. Upon receiving the remote user's request, the web host initiates communication with the personal location unit at step 44 by initiating a cellular telephone call to the personal location unit. The personal location unit may answer the call without any action by the individual nor with any notification to the individual. The web host sends a small compressed digital packet requesting the global position of the personal location unit. Such a packet need only include a single character or two, as disclosed in the above application.

Once communication with the personal location unit is initiated, the web host requests position data from the personal unit at step 46. The personal location unit then polls GPS satellites for determining its global position at 48. The GPS satellites transmit the location data and the personal location unit receives the data at step 50. The personal location unit then constructs a packet containing the global position data and sends the packet back to the web host. The web host receives the position data and stores the information at 52 either in permanent or temporary memory. At this point, cellular communication may be terminated. At 54, the web host formats the global position of the individual based upon the stored position data. The results of the formatting would be a map display, street address or position coordinates. Once this formatting is complete, the web host makes the global position information available to the concerned user at 56. The web host, associating the personal location unit number and concerned user's Internet address, constructs datagram 60 (FIG. 4) containing the individual's position. This datagram is sent to the concerned user's terminal across the Internet. The concerned user receives the datagram and a display of the global position of the individual is created at the concerned user's terminal. Once the initial map is displayed the user has the option to zoom in or out on the position of the tracking unit.

While the Internet is the preferred and most expedient method of providing communication between the concerned user and the web host, multi-user networks including Local Area Networks or Wide Area Networks using such communication connections as dial-up, ISDN, Ethernet, token ring, FDDI or other connection methods well known in the art would also provide such a communication connection. Additionally, while cellular communication is the preferred and most expedient method of providing communication between the web host and personal location unit, any wireless communication such as satellites, microwave, or infrared would provide such wireless communication. The position data received by the personal location unit 12 from the GPS satellites 36*a*–36*c* can be converted into the global position of the individual either at the personal unit itself or the raw position date can be passed to the web site and the global position calculated there. Additionally, position date may be derived from sources other than GPS such as GLONASS, Triangulation, or signal strength determination.

Referring now in more detail to protective location unit 12 of FIG. 2. Any suitable GPS 28 chip may be utilized such as a model Superstar (with antenna), available from Canadian Marconi of Quebec, CN. The GPS chip creates tracking signals 23 which included the latitude and longitude of the person wearing locator device 12. Tracking information signals 23 are transmitted to processor 34. The processor may any suitable programmable processor. Advantageously, the processor process tracking signals 23 to generate and store personal position signals 100 in memory 33. Any suitable transceiver device may be utilized. A suitable digital transceiver is available from Motorola of Schaumburg, Ill., Model 650. The transceiver may use either analog or digital lines to transmit a signal. GPS chip 28 reads the tracking signals of the locator device at any desired interval, such as every 30 minutes. The GPS chip is adjustable so that the reading interval may be adjusted as desired. Transceiver device 26 is on standby at all times. The processor stores a predetermined number of the GPS readings, for example, the previous 100 readings in memory 33. It is advantageous to store a predetermined number of previous readings in the event that a child is abducted and is held inside a building or other environment in which it is not possible to receive satellite signals and obtain GPS readings. In this case, when the locator device is called, a trail of the past 2 days positions will be downloaded to the remote station to help pinpoint the user's current location.

When a position inquiry 102 is received from the remote station in order to determine the position of location unit 12, the transceiver automatically answers the call and activates processor 34. Processor 34 is programed to automatically retrieve the personal position signals 100 stored in the memory and transmit the position signals to remote station host B via transceiver 26. The programming of the processor will be well within the purview of the average artisan in the automatic programming art having been taught the expedients and operation of the present invention. At the remote station, the digital position signals 104 are received by a modem wired to base station computer 58. The computer is programmed to convert the longitude and latitude signals for the identified location and display the position on the user's map.

In accordance with the invention, digital position signal 104 which is output by location unit 12 is in a special format so that low power requirements are needed to transmit the signal. The signal is purely a data signal and contains no voice or sound. Since there is no voice, the processor 28 outputs only a very small digital position signal 12. For example, position signal 12 may include a small digital data packet 39, containing only protocol data 12*a*, a personal code number 12*b* identifying the person to whom the locator device is assigned, longitude data 12*c*, and latitude data 12*d*. Therefore low power is required to transmit the position signals. At the remote station, the digital position signals 12 are received by a modem (not shown) wired to remote station computer 58. The computer is programmed to convert the longitude and latitude signals for the identified individual, and display the location of the user on a map 38*a*.

In accordance with the invention, digital position signal 104 which is output by location unit 12 is in a special format so that low power requirements are needed to transmit the signal. The signal is purely a data signal and contains no voice or sound. Since there is no voice, the processor 34 outputs only a very small digital position signal 104. For example, position signal 104 may include a small digital data record described above. Therefore low power is required to transmit the position signals. At the base station, the digital position signals 106 are received by a modem wired to remote station computer 58. Therefore low power is required to transmit the position signals. The high power requirements associated with analog sound and voice transmission of full cellular transmissions are eliminated. Means for powering GPS chip 28 processor 34, and transceiver device 26 may be provided by a miniature rechargeable battery system designated generally as 30. The rechargeable battery system may be a miniaturized, lightweight version of a lithium ion battery and recharging system such as disclosed in U.S. Pat. No. 5,742,233. For example, transceiver 26 may only require 0.6, or even 0.3, watts. The low power requirements for the system allows redundancy to be built into the system by way of a back-up power supply system 31, described below, which is sufficient to fire the system for position signal transmission once or twice.

In accordance with an advantageous aspect of the invention, a back-up power system, designated as 31, is provided. Back-up battery 31 may be any suitable battery which has an extended shelf life. An activation switch in the form of a key 25 is provided which normally locks the back-up power supply 31. The back-up power system 31 allows the processor 34 and transceiver 26 to operate once or twice when the primary power source 30 is completely drained. Once the key 25 has been activated to use the power back-up system, the battery 31 will be fully expended, but a new battery may be inserted after use. Battery 31 may be a suitable watch battery having a shelf life of about one year.

While the digital telephone system is preferred, national coverage may not presently exist for digital technology. When national coverage does exist, the digital technology will provide an advanced location system which will have faster and more long distance communication and longer battery life. However, for the present, the wireless communications between the protective location device 12 and the remote station 58 may be had using cellular analog transmissions. Cellular telephone systems currently provide national coverage necessary to allow the location device to function on a national basis.

The processor 34 remains in a standby, power reducing mode until one of two events occurs. Either the host or base station makes a call or the emergency key 25 is pressed. In the first case, the remote station sends out a cellular call transceiver 26 and processor 34 answers the call. If the call is to the correct number, i.e. location unit, processor 34 reads the present GPS tracking signal 102, and transmits the present coordinates via transceiver 26 to the remote station. The personal location device can also transmit previously stored coordinates in memory 33 to the host as described above. For this purpose, processor 34 may be programmed to send either the current position signal, the position history which includes all the stored position signals, or any number of the stored signals in response to a coded inquiry call 102. Processor may be programmed to send the desired signals depending on a corresponding inquiry signal from the remote station or host. Typically, only the current position signal will be transmitted when key 25 is pulled to activate the system in an emergency.

The back-up power supply system provides the redundancy necessary to allow the personal location device to function reliably. The back-up power supply system allows the personal location device to provide location information to the remote station even if the primary power source is drained. While the preferred embodiment is an Internet based system, it is also to use location unit 12 in a personal tracking system as can best be seen in FIGS. 3 and 4. The personal location may be worn by a child's toy such as a stuffed bear 110 by means of a thin, elongated rectangular housing 52 in which the device 12 is housed. Alternately, the personal location unit may be worn by the child when it is not practical or desirable to carry the toy bear 110. Advantageously, location unit 12 may be placed in a conventional back pack like one typically worn by a child to school. The device may be concealed underneath the child's clothing or other inconspicuous place so the device may be activated if the child is abducted.

If the child is lost, or otherwise encounters an emergency situation, activation switch 25 is turned and activated whereby an emergency GPS signal is transmitted to the remote station to tell the remote station where the child is located. Each personal location device will have a code number which is also transmitted with the GPS signal data so that the remote station knows exactly who the individual is. At that time the remote station will also contain information for contacting a person to be notified in the case of an emergency which may be the parents of the child or other person related to the individual.

This application claims the priority of U.S. Provisional Application Ser. Nos. 60/118,983 filed on Feb. 5, 1999 and 60/153,350 filed on Sept. 10, 1999 which applications are hereby incorporated in this disclosure by reference.

While a preferred embodiment of the invention has been described using specific terms, such description is for illustrative purposes only, and it is to be understood that changes and variations may be made without departing from the spirit or scope of the following claims.

What is claimed is:

1. An Internet based personal tracking system for tracking the position of a portable location unit which transmits position data representing the geographical position of the unit, wherein the system may be accessed by a remote user from a remote terminal and comprises:

a web host connected to the Internet having a computer readable medium;

a computer program residing on said web host having a set of computer readable instructions which include:

input instructions for receiving a tracking request signal from the remote user via the Internet, said tracking request having a location unit identification;

processing instructions for receiving said tracking request signal and processing and routing said tracking request signal;

communication instructions initializing wireless communication with the location unit;

location instructions responsive to said processing instructions for generating a position call signal and outputting said call signal to the location unit and for receiving said position data from said location unit, and a display module for outputting said position data for display of the location unit's position by the remote user via the Internet; and error instructions for processing a no communication signal when communications fail between said web host and the location unit; and generating a no communication signal outputted from said web host to said remote user.

2. The system of claim 1 wherein said computer readable instructions include formatting instructions for formatting said position data into a display map of the current position of the location unit, and display instructions for outputting said map to the remote user via the Internet.

3. The system of claim 2 wherein said display map includes a position indicator indicating the current position.

4. The system of claim 1 wherein said tracking request signal includes a unit ID number, and said computer readable instructions include:

validation instructions for comparing said unit ID number to an access code stored on said web host; and said instructions allowing said input instructions to generate said call signal only when said unit ID number corresponds to an authorized access code.

5. The system of claim 1 wherein said error instructions include means to generate a no data signal in response to said location instructions failing to receive said position data from said location unit; and display instruction outputting said no data signal from said web host to said remote user.

6. The system of claim 1 wherein said input instructions are contained in an input module, said communications instructions are contained in a communications module, said location instructions are contained in a location module, and said display instructions are contained in a display module; and including a main processing module for calling said communication, location, and display modules to carry out their respective instructions.

7. The system of claim 6 wherein said validation instructions are contained in a validation module called by said main module.

8. A computerized system for determining the location of a portable location unit wherein a system subscriber maintains a remote computer terminal, said system comprising:

a web host connected to a wide area web network, said web host having a computer readable medium;

a location unit for being carried by one of an individual and other moving object for calculating the location of the unit at any given time and transmitting a low power digital location data packet having location data, wherein the data packet includes only protocol data, a personal code number as an identifier, and GPS data, including latitude and longitude; and a computer program having instructions embodied in computer readable code residing on said web host for receiving a tracking request from the subscriber, transmitting a tracking call to said location unit, receiving back the low power digital location data packet having location data from said location unit representing the current position of the unit automatically in response to said tracking request, and transmitting the location data regarding the current position of the unit to said subscriber whereby the location of the unit is displayed at the subscriber's terminal.

9. The system of claim 8 wherein said location unit includes a transceiver for transmitting said low powered digital location data packet to said subscriber's terminal; and a processor for controlling said transceiver to generate and transmit said location data packet in response to automatically answering said tracking request from said web host; and a power supply for supplying power to said processor and said transceiver.

10. The system of claim 9 wherein said program includes instructions to return said processor to a standby power mode after said transceiver has transmitted said location data packet to said subscriber's terminal.

11. The system of claim 10 wherein said transceiver transmits said location data packet without any accompanying audio voice signal.

12. The system of claim 11 including an auxiliary power supply for supplying power to the processor and transceiver when said main power supply to insufficient to transmit said signal.

13. A system for determining the geographical location of a portable location unit carried by one of an individual and other moving object by a system subscriber to whom the location unit is assigned wherein said location unit calculates the location of the unit at any given time, wherein said location unit includes a processor and transmitter to transmit a low power digital location data packet having location data, and a memory for storing a plurality of previous position readings, said processor operative for automatically retrieving position readings stored in memory upon receipt of a tracking request, said system comprising:

a web host connected to a wide area web network, said web host having a computer readable medium;

said web host being accessible by the subscriber from a remote computer terminal;

a computer program residing on said web host for receiving a tracking request from the subscriber and transmitting a tracking call to the location unit; and said computer program including instructions embodied in computer readable code for automatically transmitting said tracking call, receiving the lower power digital location data packet having location data, including retrieved position readings stored in memory, from the location unit in response to said tracking call, and transmitting location data regarding the current position of the unit to the subscriber's terminal where the current location of the unit is displayed and a prior path or track of the location unit.

14. A method of locating a portable location unit carried by one of an individual and, other moving object by system subscribers having a computer terminals with a display, said method comprising:

providing a web host connectable to a plurality of the subscriber's computer terminals concurrently;

providing a plurality of location units assigned to respective system subscribers;

receiving a tracking request at said web host initiated at one of the subscriber's terminal seeking the present location of the assigned location unit;

transmitting a tracking call to the location unit whose location is desired in response to receiving said tracking request;

receiving a low power digital location data packet having location, wherein the data packet includes only protocol data, a personal code number as an identifier, and GPS data, including latitude and longitude, data at said web host from the location unit representing the current location of the unit in response to said tracking call; and transmitting said location data to the computer terminal of the subscriber for display of the current location of the unit on the subscriber's terminal display.

15. The method of claim 14 comprising the steps of:

receiving a subscriber's access code entered by the subscriber;

providing a database of valid access codes stored on said web host;

comparing said subscriber's access code to said database of valid access code on said web host; and, allowing input of said tracking request on said web host only upon discovering a match between said subscriber's access code and said valid access codes within said database.

16. The method of claim 14 further comprising the steps of:

receiving on the web host a history of position points from said location unit;

formatting said position points on said web host into a tracking path representing the history of travel of said location unit; and, outputting said travel path from said web host to the subscriber's terminal via the Internet.

17. A method of locating a portable location unit carried by one of an individual and other moving object, said method comprising:

establishing a subscription to a web host accessible from a subscriber's computer terminal;

assigning a location unit to the subscriber wherein said location unit includes a processor and transmitter operable for transmitting a low power digital location data packet having location data, and a memory for storing a plurality of previous position readings, said processor operative for automatically retrieving position readings stored in memory upon receipt of a tracking request;

receiving a tracking request initiated at said subscriber's terminal at said web host whereby a tracking call is transmitted from said web host to the location unit assigned to the subscriber, and a low power digital packet having location data representing the location of the vehicle is received from the location unit by said web host; and transmitting said location data, including retrieved position readings stored in memory to said subscriber's terminal so that the location of the unit may be displayed on the subscriber's terminal display or a prior path or track of the location unit.

18. In an Internet based system for tracking the location of one of an individual and other moving object wherein the system includes a web host and a system subscriber who maintains a remote subscriber computer terminal, a portable location unit comprising:

an enclosure;

a GPS location chip carried within the enclosure for receiving raw Geo-position information;

a processor included in said location unit for automatically processing said raw Geo-position information to generate a low power digital location data packet which includes protocol data, a personal code number as an identifier, and GPS location data in response to a tracking call;

a low power transceiver receiving the tracking call from the web host for transmitting said low power digital location data packet to said web host, said low power transceiver having a capacity for transmitting only digital data without any audio component;

a processor controlling said transceiver to transmit said location data packet in response to automatically answering said tracking call from said web host; and a power supply for supplying power to said processor and low power transceiver.

19. The location of claim 18 wherein said processor controls said transceiver to return to the standby power mode after transmitting said data packet.

* * * * *